US008162437B2

(12) United States Patent
Edwards et al.

(10) Patent No.: US 8,162,437 B2
(45) Date of Patent: Apr. 24, 2012

(54) INK JET PRINTER

(75) Inventors: Paul Andrew Edwards, Ypsilanti, MI (US); John Hennessy, Grosse Pointe Park, MI (US); Frank Bruck, Ypsilanti, MI (US)

(73) Assignee: Electronics for Imaging, Inc., Foster City, CA (US)

( * ) Notice: Subject to any disclaimer, the term of this patent is extended or adjusted under 35 U.S.C. 154(b) by 0 days.

(21) Appl. No.: 12/913,617

(22) Filed: Oct. 27, 2010

(65) Prior Publication Data

US 2011/0037807 A1 Feb. 17, 2011

Related U.S. Application Data

(63) Continuation of application No. 11/851,876, filed on Sep. 7, 2007, now Pat. No. 7,828,412.

(60) Provisional application No. 60/843,490, filed on Sep. 8, 2006, provisional application No. 60/843,494, filed on Sep. 8, 2006, provisional application No. 60/843,477, filed on Sep. 8, 2006, provisional application No. 60/843,478, filed on Sep. 8, 2006, provisional application No. 60/843,495, filed on Sep. 8, 2006.

(51) Int. Cl.
*B41J 23/00* (2006.01)

(52) U.S. Cl. ..... 347/37; 347/8; 347/14

(58) Field of Classification Search ..... 347/5, 14, 347/16, 19, 37, 85–86, 101, 104
See application file for complete search history.

(56) References Cited

U.S. PATENT DOCUMENTS

| | | | |
|---|---|---|---|
| 3,869,986 | A | 3/1975 | Hubbard |
| 4,086,997 | A | 5/1978 | Wu |
| 4,465,800 | A | 8/1984 | Bhatia |
| 4,493,252 | A | 1/1985 | Clark |
| 4,803,119 | A | 2/1989 | Duff et al. |
| 4,915,517 | A | 4/1990 | Husome |
| 4,937,593 | A | 6/1990 | Prats |
| 4,940,998 | A | 7/1990 | Asakawa |
| 4,951,067 | A | 8/1990 | Spehrley, Jr. |
| 5,055,856 | A | 10/1991 | Tomii et al. |

(Continued)

FOREIGN PATENT DOCUMENTS

DE 10051088 4/2002

(Continued)

OTHER PUBLICATIONS

"A Plastic Fabrications information page. Definitions and terms."; printed on Oct. 17, 2006 from Industrial Quick Search, Inc. : http://www.plasticfabricatior.com/info/plasticfabricator/def.htm.

(Continued)

*Primary Examiner* — Thinh Nguyen
(74) *Attorney, Agent, or Firm* — Michael A. Glenn; Glenn Patent Group

(57) ABSTRACT

An ink jet printer for printing on a substrate comprising a first print head outputting ink and defining an ink meniscus; a platen operable to carry the substrate; a support structure; and a print head mechanism coupled to the support structure and carrying the first print head. The print head mechanism moves the first print head relative to the platen. A controller controls the print head mechanism such that at least one of a predetermined acceleration and predetermined deceleration of the print head mechanism is achieved such that the ink meniscus is operably maintained.

34 Claims, 14 Drawing Sheets

U.S. PATENT DOCUMENTS

| | | | | |
|---|---|---|---|---|
| 5,104,448 | A | 4/1992 | Kruse | |
| 5,154,761 | A | 10/1992 | Cooke et al. | |
| 5,160,535 | A | 11/1992 | Cooke et al. | |
| 5,376,169 | A | 12/1994 | Hotomi et al. | |
| 5,393,331 | A | 2/1995 | Loria et al. | |
| 5,417,113 | A | 5/1995 | Hartley | |
| 5,443,628 | A | 8/1995 | Loria et al. | |
| 5,467,973 | A | 11/1995 | Graushar et al. | |
| 5,510,415 | A | 4/1996 | Zahrobsky et al. | |
| 5,565,143 | A | 10/1996 | Chan | |
| 5,616,450 | A | 4/1997 | Arai et al. | |
| 5,630,363 | A | 5/1997 | Davis et al. | |
| 5,725,985 | A | 3/1998 | Nealey et al. | |
| 5,739,833 | A | 4/1998 | Yamazaki et al. | |
| 5,847,743 | A | 12/1998 | Look | |
| 5,985,079 | A | 11/1999 | Ellison | |
| 6,019,046 | A | 2/2000 | Rodi | |
| 6,048,914 | A | 4/2000 | Goto et al. | |
| 6,070,976 | A | 6/2000 | Takagi et al. | |
| 6,113,679 | A | 9/2000 | Adkins et al. | |
| 6,126,281 | A | 10/2000 | Shimoda et al. | |
| 6,231,654 | B1 | 5/2001 | Elwakil | |
| 6,254,218 | B1 | 7/2001 | Suzuki et al. | |
| 6,276,273 | B1 | 8/2001 | Aurenty et al. | |
| 6,328,418 | B1 | 12/2001 | Yamada et al. | |
| 6,346,353 | B1 | 2/2002 | Wang et al. | |
| 6,413,590 | B1 | 7/2002 | Anderson et al. | |
| 6,443,568 | B1 | 9/2002 | Askeland et al. | |
| 6,455,136 | B1 | 9/2002 | Okajima et al. | |
| 6,523,949 | B1 | 2/2003 | Ewert | |
| 6,530,645 | B2 | 3/2003 | Haflinger | |
| 6,533,379 | B1 | 3/2003 | Kubota | |
| 6,575,558 | B1 | 6/2003 | Grose et al. | |
| 6,585,369 | B1 | 7/2003 | Sievert et al. | |
| 6,588,889 | B2 | 7/2003 | Jeanmaire | |
| 6,675,646 | B2 | 1/2004 | Nishihara et al. | |
| 6,725,705 | B1 | 4/2004 | Huebler et al. | |
| 7,393,073 | B2 | 7/2008 | Zach | |
| 7,597,419 | B2 * | 10/2009 | Herwald et al. | 347/37 |
| 2001/0007464 | A1 | 7/2001 | Kellett | |
| 2002/0029723 | A1 | 3/2002 | Fox et al. | |
| 2002/0096241 | A1 | 7/2002 | Instance | |
| 2002/0109738 | A1 | 8/2002 | Ozawa | |
| 2002/0182376 | A1 | 12/2002 | Mukherjee et al. | |
| 2002/0183419 | A1 | 12/2002 | Lin et al. | |
| 2003/0081061 | A1 | 5/2003 | Gunther et al. | |
| 2003/0107635 | A1 | 6/2003 | Kinning et al. | |
| 2003/0143346 | A1 | 7/2003 | Yoshizawa et al. | |
| 2003/0214554 | A1 | 11/2003 | Tschida | |
| 2003/0218663 | A1 | 11/2003 | Baxter et al. | |
| 2003/0224150 | A1 | 12/2003 | Ludwig et al. | |
| 2004/0023087 | A1 | 2/2004 | Redmond | |
| 2004/0080595 | A1 | 4/2004 | Taguchi et al. | |
| 2004/0090866 | A1 | 5/2004 | Goodman et al. | |
| 2004/0121173 | A1 | 6/2004 | St. Arnauld | |
| 2004/0154484 | A1 | 8/2004 | Herzbach et al. | |
| 2004/0179062 | A1 | 9/2004 | Rai et al. | |
| 2004/0201661 | A1 | 10/2004 | Li | |
| 2005/0000842 | A1 | 1/2005 | Timmerman et al. | |
| 2005/0129879 | A1 | 6/2005 | Bodis | |
| 2005/0189066 | A1 | 9/2005 | Look et al. | |
| 2005/0209075 | A1 | 9/2005 | Kocherga et al. | |
| 2005/0264622 | A1 | 12/2005 | Silverbrook et al. | |
| 2006/0050286 | A1 | 3/2006 | Silverbrook et al. | |
| 2006/0092221 | A1 | 5/2006 | Jeong | |
| 2007/0273740 | A1 * | 11/2007 | Tucker et al. | 347/106 |

FOREIGN PATENT DOCUMENTS

| | | | |
|---|---|---|---|
| EP | 0628956 | | 12/1994 |
| EP | 963854 | A2 | 12/1999 |
| EP | 1293344 | | 3/2003 |
| EP | 1308491 | A2 | 5/2003 |
| EP | 1367101 | | 12/2003 |
| JP | 09071040 | | 3/1997 |
| JP | 2004/034675 | | 2/2004 |
| WO | WO 01/45957 | | 3/1997 |
| WO | WO 02/055619 | | 7/2002 |
| WO | WO 02/006294 | | 8/2002 |
| WO | WO 02/062894 | A1 | 8/2002 |
| WO | WO 2004/022353 | | 3/2004 |
| WO | WO 2004/043702 | | 5/2004 |

OTHER PUBLICATIONS

"Printing industry meanings, terms for printing—The Works Printing Group"; printed on Oct. 17, 2006 from the website of The Works Printing Group: http:www.twpg.com/au/Retail/glossary.htm.

* cited by examiner

INK JET PRINTER

CROSS REFERENCE TO RELATED APPLICATIONS

This application is a Continuation of U.S. application Ser. No. 11/851,876, entitled Ink Jet Printer, filed 7 Sep. 2007 now U.S. Pat. No. 7,828,412, which claims the benefit of U.S. Provisional Application No. 60/843,490 filed on 8 Sep. 2006; U.S. Provisional Application No. 60/843,494 filed on 8 Sep. 2006; U.S. Provisional Application No. 60/843,477 filed on 8 Sep. 2006; U.S. Provisional Application No. 60/843,478 filed on 8 Sep. 2006; and U.S. Provisional Application No. 60/843,495 filed on 8 Sep. 2006, each of which is incorporated herein in its entirety by this reference thereto.

FIELD

The present teachings relate to ink jet printers and, more particularly, relate to ink jet printers having a print head and/or platen that is moved using precision controlled servo motors.

BACKGROUND

The statements in this section merely provide background information related to the present teachings and may not constitute prior art.

Ink jet print heads tend to be sensitive to bumping or jolting. This relates to the fact that there is very sensitive control on the ink meniscus at the nozzle orifice. This bumping and jolting can occur when the head is moved up and down for cleaning or to re-thread the substrate. If a print head is jolted too much, then the meniscus can be lost and air becomes entrapped into the nozzle orifice resulting in missing jets. Loss of jets in a single pass printing activity can cause print quality defects, which are generally not acceptable. This is worse in some print heads, such as the grayscale print heads, which are very sensitive to loss of jets when jolted or vibrated, but occurs to some extent in all ink jet heads.

Little has been done in the past to adequately resolve this problem. Systems tend to be fitted with air driven or manual actuators which move the print heads up and down. This technique does tend to improve the control of head movement over a more manual process, but has proven to be insufficient. Air actuators are especially vulnerable to reduced motion quality with time.

Separate from the above issue, ink jet print systems often rely upon the extremely precise placement of their print heads. If the print heads can be accurately aligned and secured, it is then possible to set two heads in relation to each other such that the nozzle ports are "interleaved". This interleaved configuration results in a doubling of the print dot density, so that two heads, each with 150 dots per inch (DPI) resolution, can print like a single 300 DPI print head.

Aside from achieving the interleaved configuration described above, print heads are commonly placed side by side to gain additional print width. Print heads can be "stitched" together in this manner to create wide format printers made up of a series of narrow heads that have been stitched together. The accuracy with which the heads are stitched together must also be high as it is not generally acceptable to have either a gap or and overlap in the printed image. For these reasons and others around print quality, the ability to secure and align print heads in the system may be important to functionality.

Previous work to interleave and stitch print heads together have centered on a trial and error methodology, whereby prints are generated and visually checked (under a low power microscope) for interleave and stitch accuracy. If the prints show a misalignment condition, the heads are loosened, moved to a new location, and re-tightened. This method is repeated until all heads are interleaved and stitched properly. It should be appreciated that this process is very time consuming, since moving one head necessitates moving all other heads as their locations are interrelated. Other methods that use an optical alignment tool to interleave two heads together use non-reversible adhesives to bond the heads together. This method has the inherent risk such that if the alignment is not accurate after the bond is set, no corrections can be made, and thus, the heads must be scrapped.

Still further, industrial ink jet printing systems often rely on a smooth support surface to support the substrate in the web zone where printing is being done (where the ink jets are jetting). This requirement is to maintain the optimized distance between the substrate and the print heads.

Print platens are commonly designed and manufactured to be smooth, flat surfaces, slightly wider than the substrate itself, and long enough to accommodate the print zone length. The substrate is transported to and from the print platen by a series of web rollers incorporated into the printer.

During printing, some substrates tend to curl up along the edges. This is especially true if the substrate is made of multiple layers, e.g., a pressure sensitive adhesive label stock with a printable top surface, adhesive layer, and a removable backing paper. Such substrates tend to curl at the edges regardless of increasing speed or tension. It should be readily appreciated that this curling action changes the physical position of that portion of the substrate in relation to the print heads, which results in poor print quality along the edges or significant reduction in printable width for a given substrate width.

Conventional designs of print platens have primarily centered on full surface flat plates or full surface curved surfaces. However, flat platen designs do not address the curled substrate issue. Conversely, full surface curved platens are cost prohibitive because of the challenging machining that is required to manufacture.

Finally, the sustainability, jetting quality, and ultimate print quality of the ink used in digital ink jet printing are affected when the temperature of the ink is not accurately controlled prior to entering the print head. Although methods of thermal conditioning have been used before, the techniques according to the present teachings show significant improvement.

Previous work to control the temperature of the ink was mostly limited to the use of the water jacket or an electric heater attached to a print head. However, such techniques failed to provide effective and reliable results.

SUMMARY

According to the principles of the present teachings, an ink jet printer is provided having a print head that is accurately positionable in response to servo control. The present teachings seek to eliminate the problem of lost jets due to the jolting of print heads when they are moved to the non printing or cleaning position during operation of the printing system by accurately and smoothly moving the print head.

The present teachings are superior to those methods previously used because they provide for significantly greater control over the entire range of movement of the print head, especially the key periods of acceleration and deceleration when the head is most susceptible to losing the nozzle meniscus. The system is also less prone to issues related to variability in air pressure and wear in components leading to rapid changes in acceleration. The system also allows for the accurate and rapid setting of print head-to-substrate gap (or print head-to-platen gap).

In some embodiments, the platen is moved down and out of the way while maintaining the print head in a stationary position, which solves the loss of jets due to head motion by allowing the heads to remain still while the platen is moved. The present teachings are superior to the prior art in that they ensure that there is no unacceptable head motion or vibration which can cause lost jets. In a manufacturing process this translates to considerably improved machine set up times and reduction in lost time for maintenance activities. The ability to be able to precisely locate the position of the platen beneath the print head also allows for ease of optimization of print distance when switching substrates. That is, with DOD ink jet technology, the distance of the print head to the substrate is quite small (around 1 mm) and needs to be accurately controlled.

In some embodiments, an apparatus and method for configuring, securing, and/or aligning multiple ink jet print heads on a printing machine is provided. The present teachings are superior to the methods previously used because they allow for the fine and accurate adjustment of print heads in a digital print system, without the extended trial and error method, or the risk of a bonded poor alignment. The set up time when installing new print heads is greatly reduced, and there is no risk of scrapping expensive heads of the optically aligned heads print with interleave variance.

Further areas of applicability will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

DETAILED DESCRIPTION

The following description is merely exemplary in nature and is not intended to limit the present teachings, application, or uses.

Figure 1A:
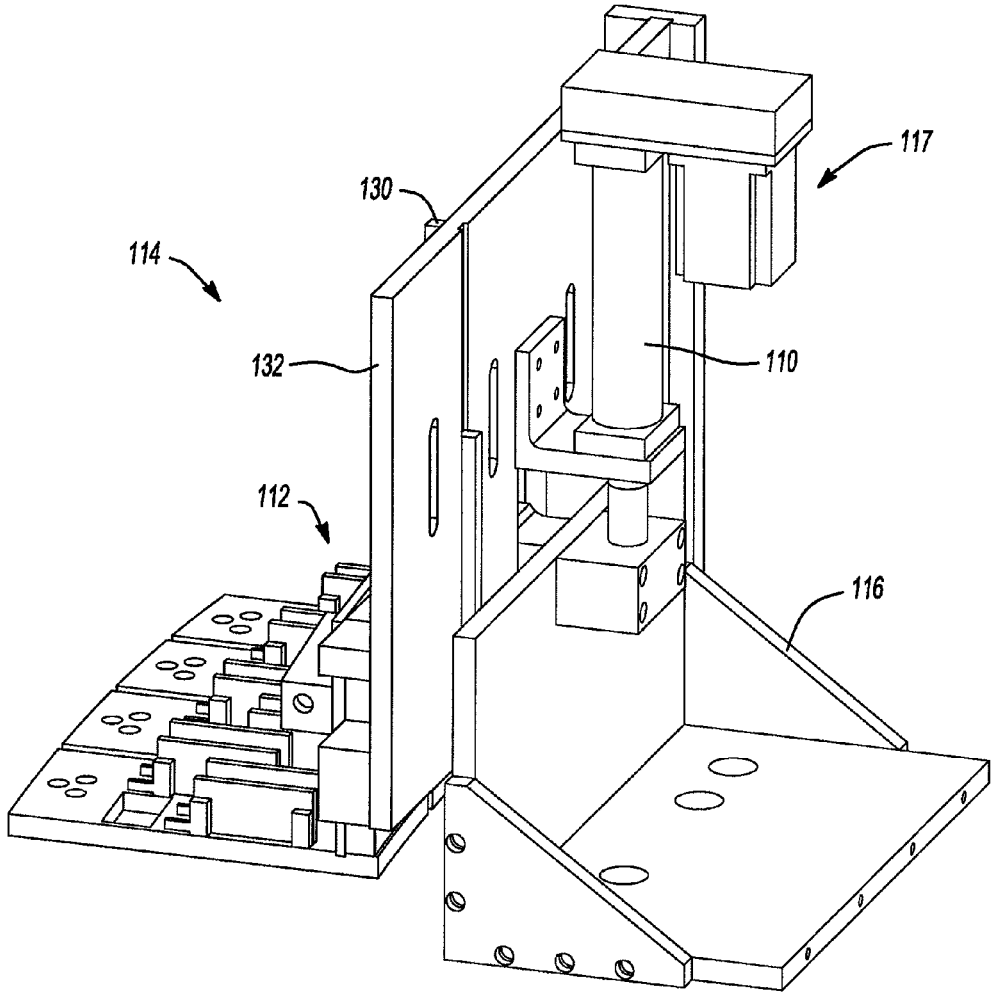
FIG. 1A is a perspective view illustrating the ink jet printer according to the principles of the present teachings.
Figure 1B:
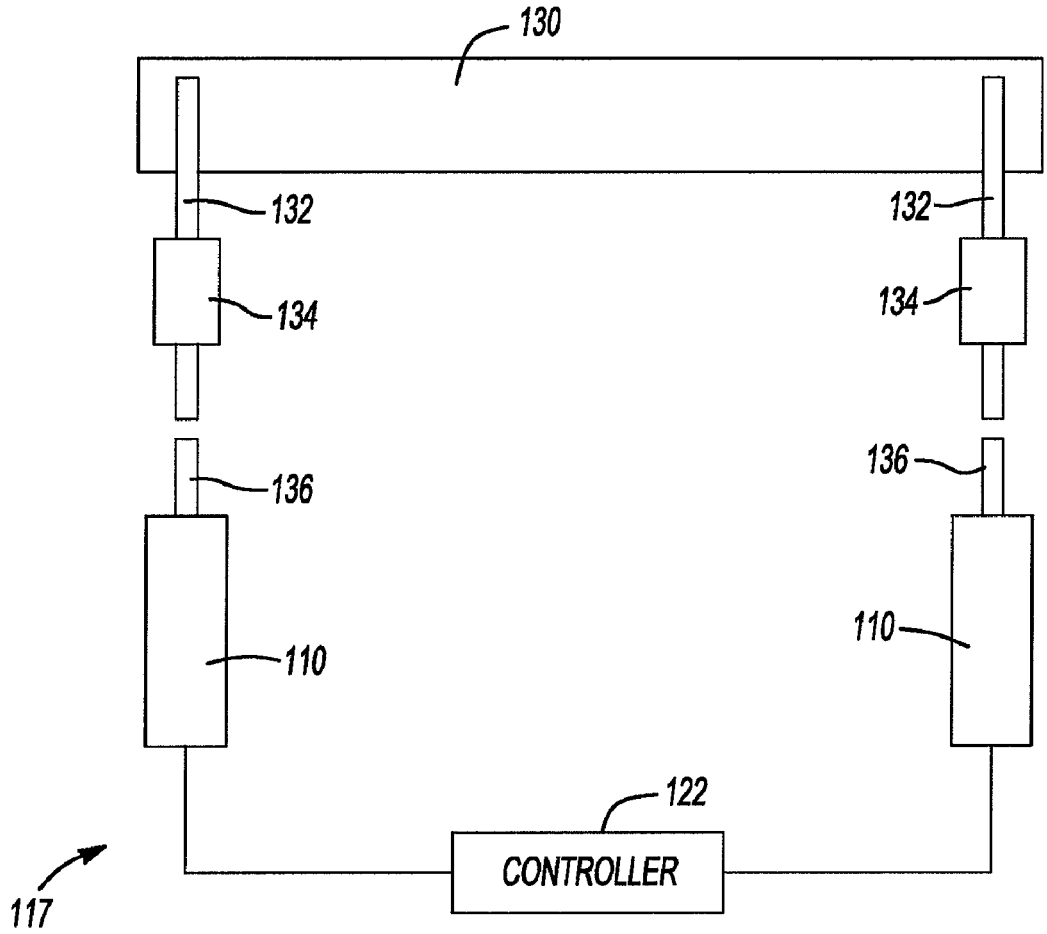
FIG. 1B is a schematic view illustrating the ink jet printer according to the principles of the present teachings.
Figure 2:
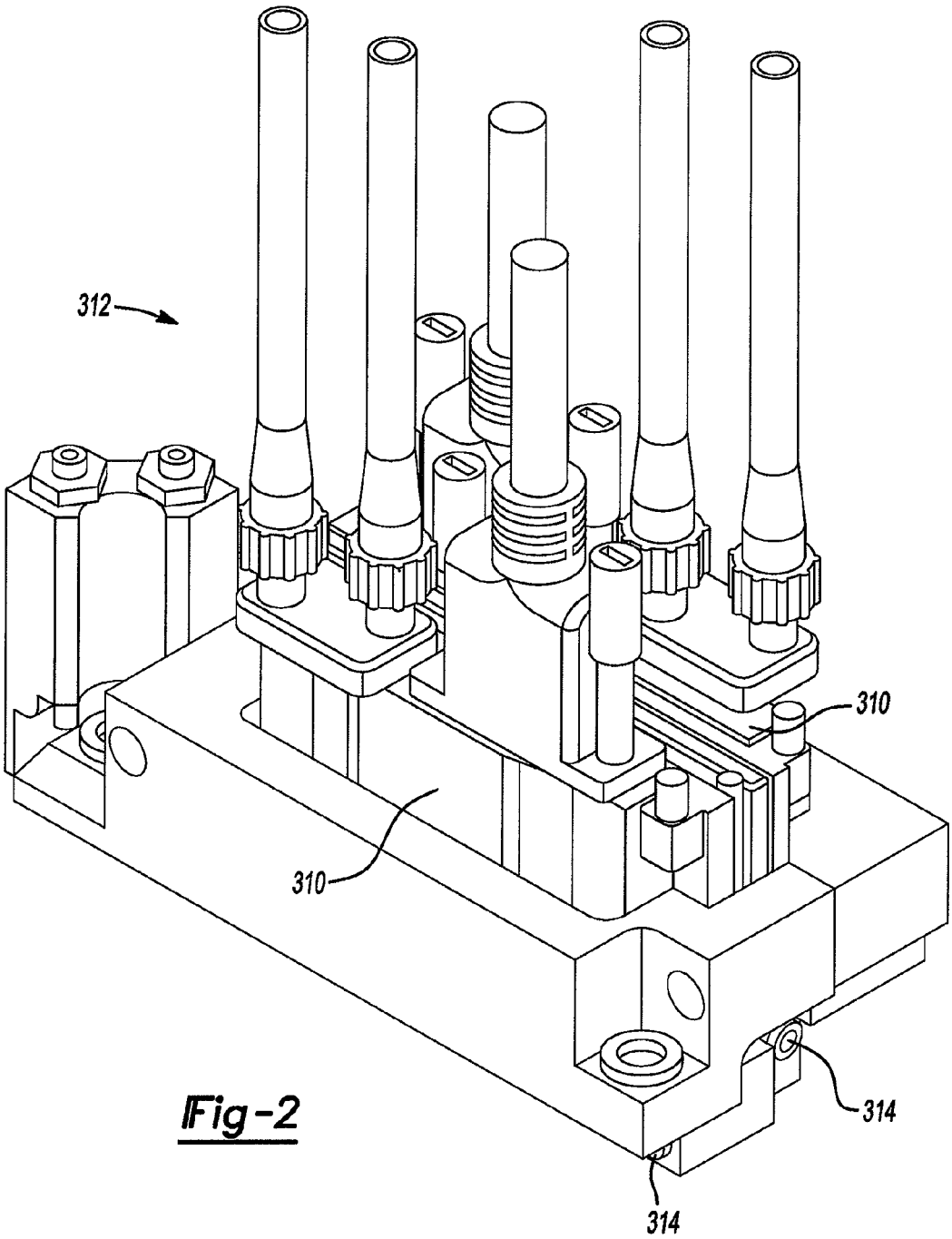
FIG. 2 is a perspective view illustrating the configuring, securing, and/or aligning system according to the present teachings.
Figure 3:
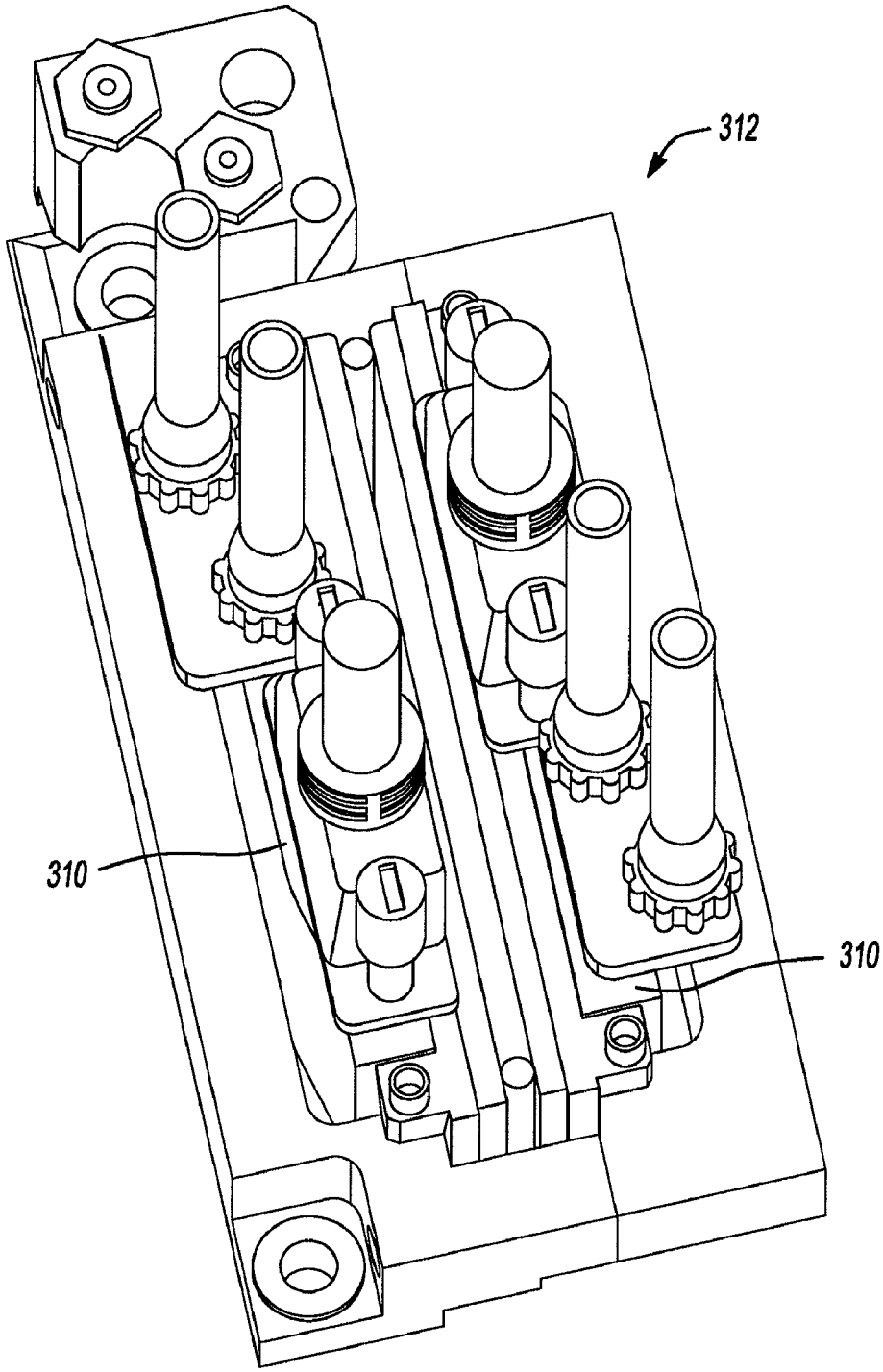
FIG. 3 is a top perspective view illustrating the configuring, securing, and/or aligning system according to the present teachings.
Figure 4:
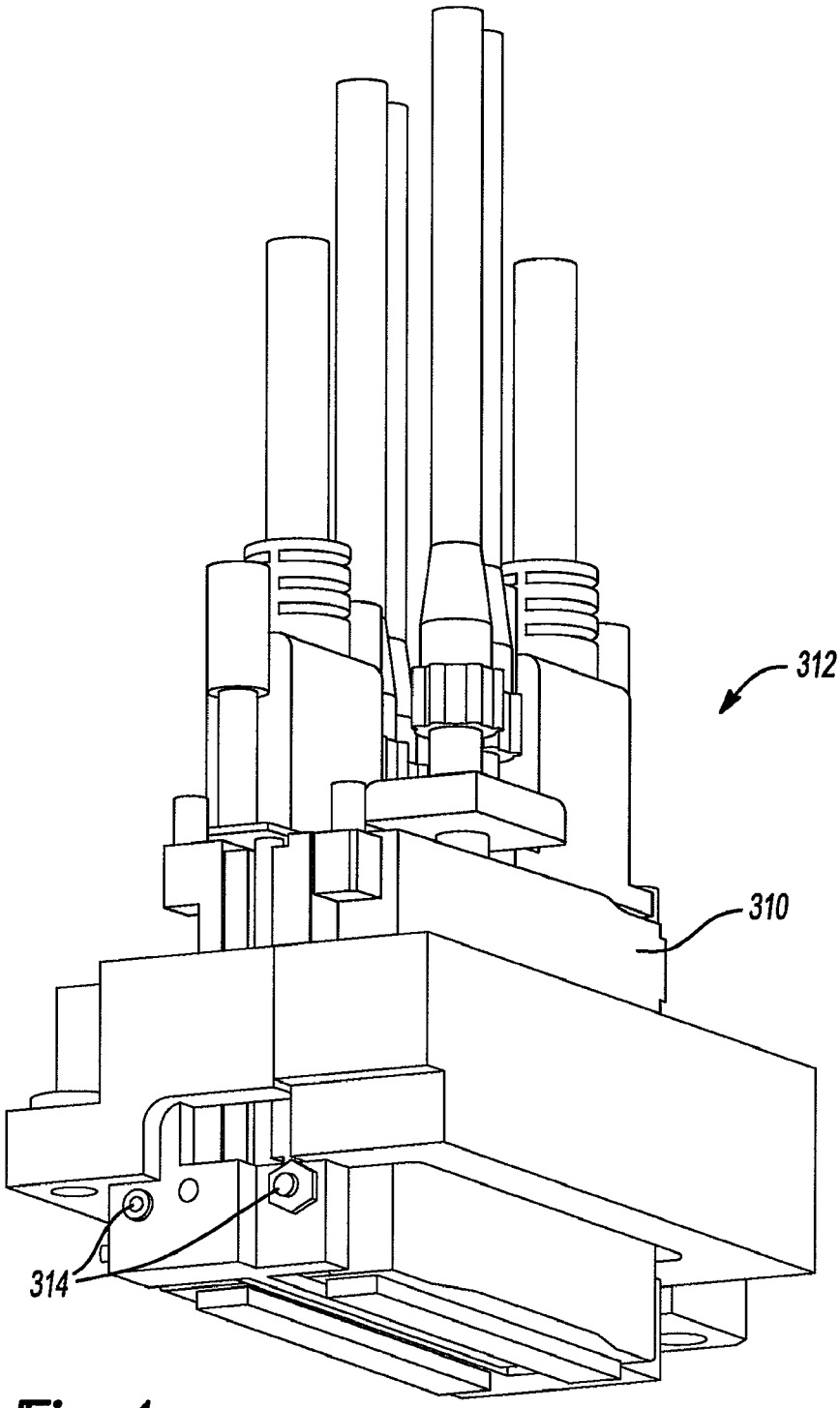
FIG. 4 is a back bottom perspective view illustrating the configuring, securing, and/or aligning system according to the present teachings.
Figure 5:
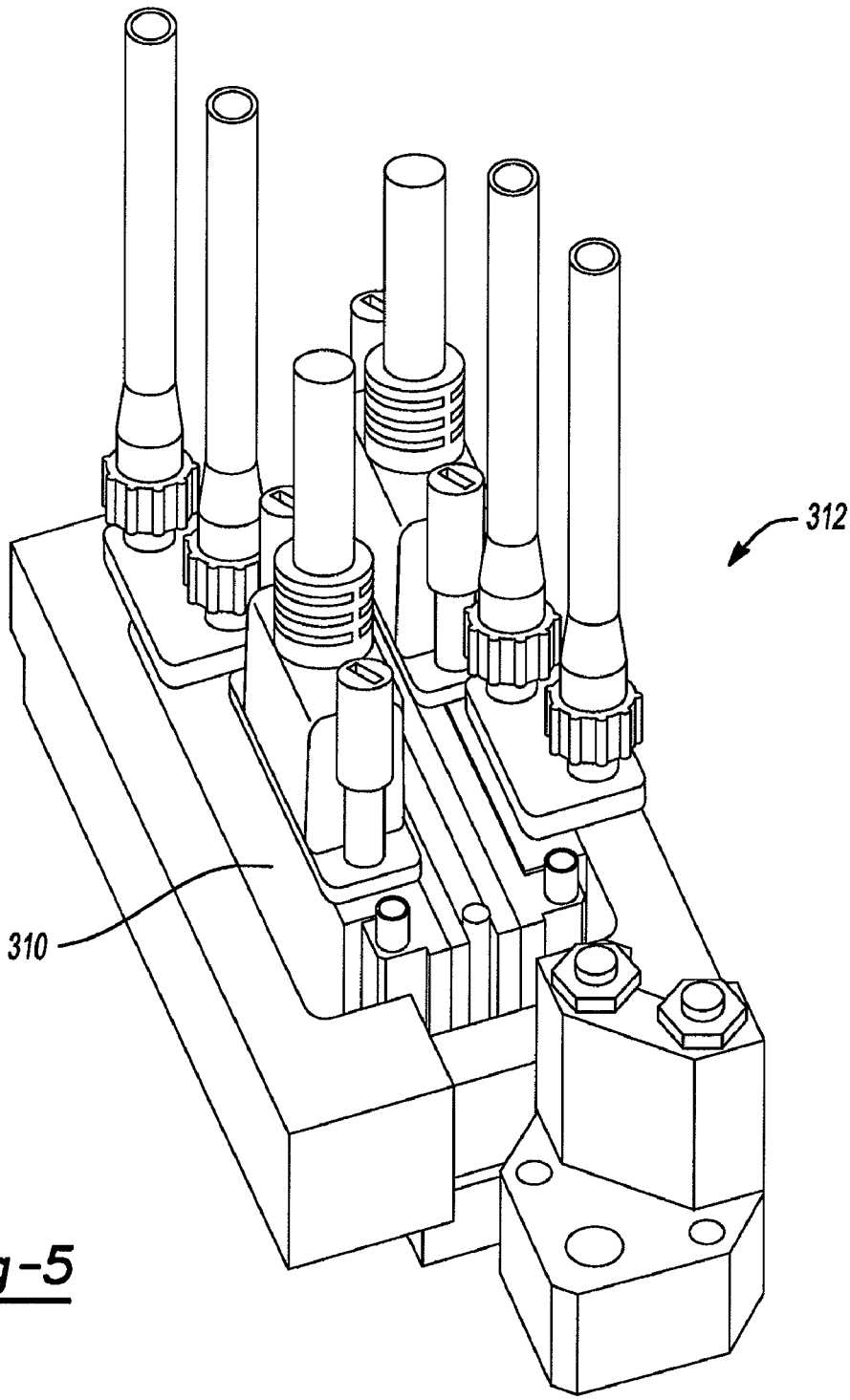
FIG. 5 is a side perspective view illustrating the configuring, securing, and/or aligning system according to the present teachings.
Figure 6:
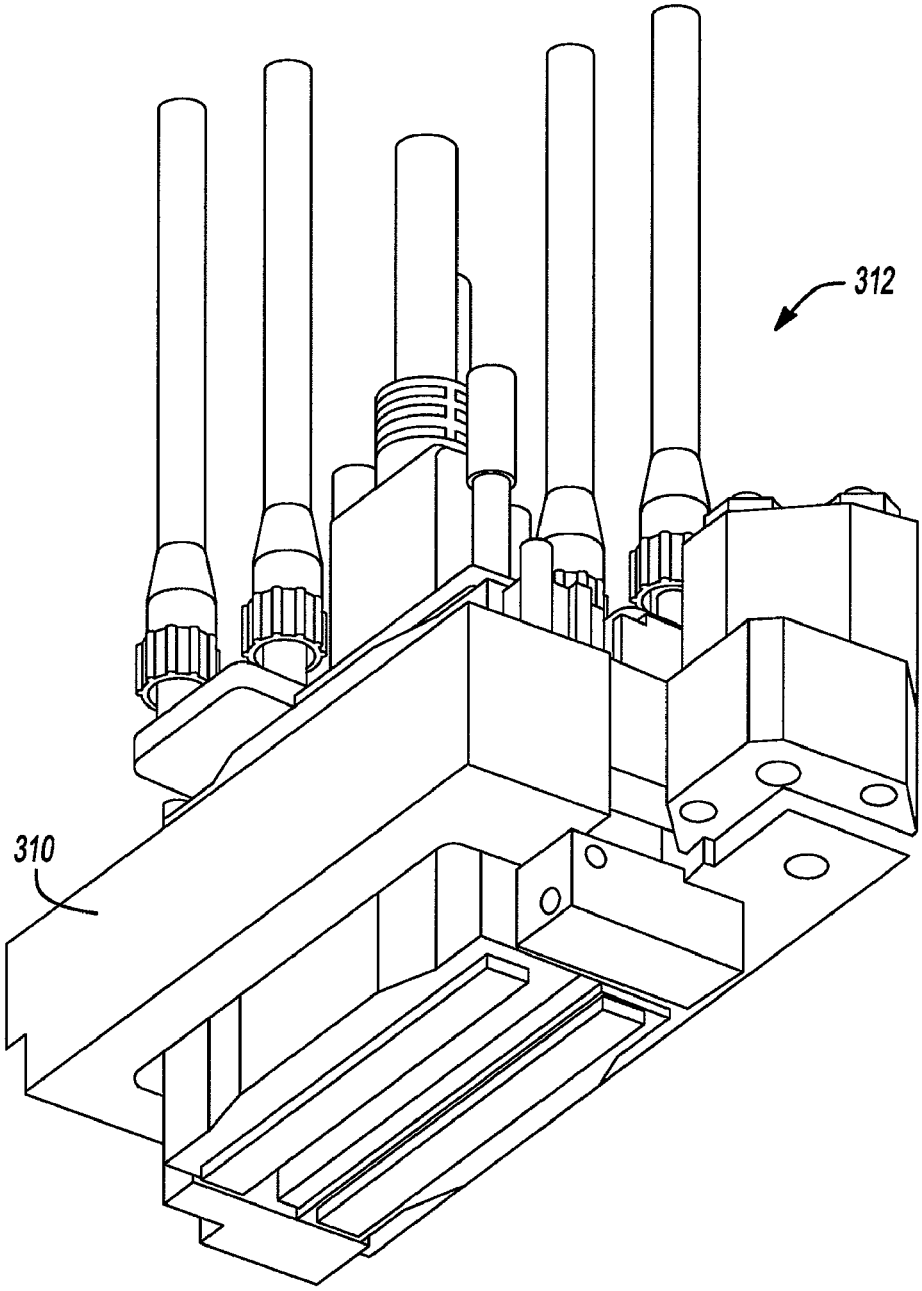
FIG. 6 is another bottom perspective view illustrating the configuring, securing, and/or aligning system according to the present teachings.
Figure 7:
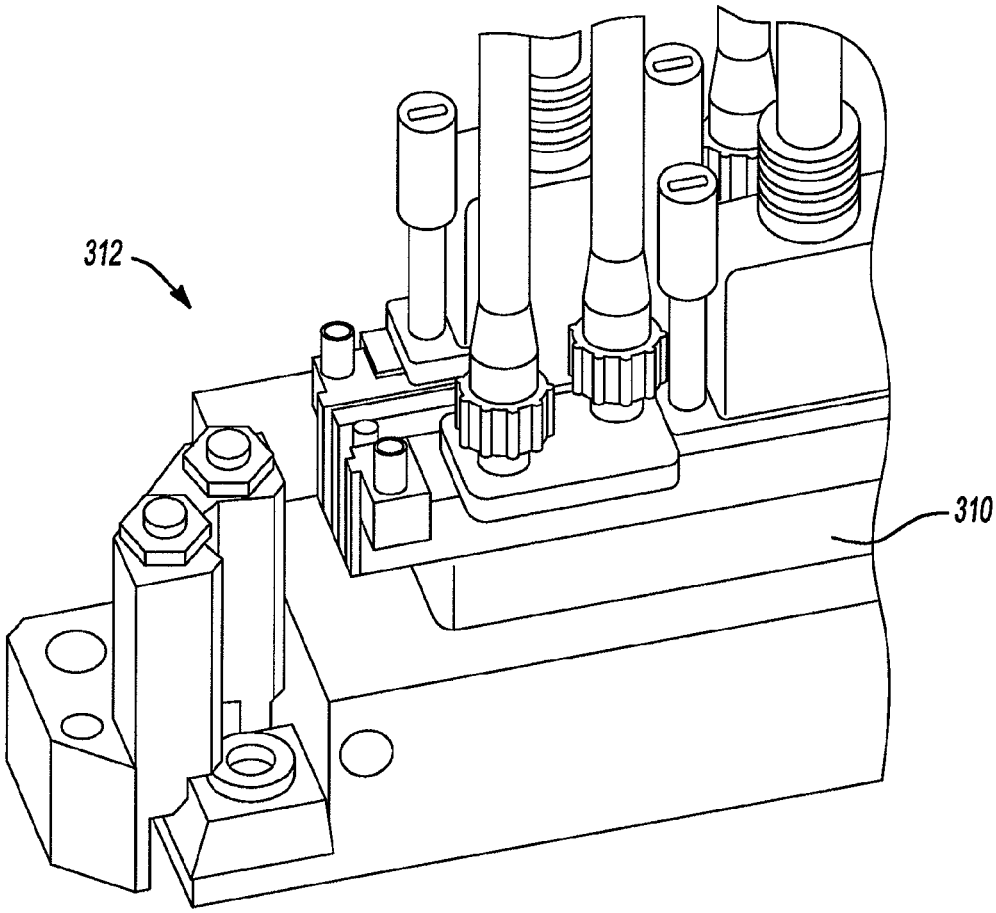
FIG. 7 is an enlarged top perspective view illustrating the configuring, securing, and/or aligning system according to the present teachings, with portions shown transparent.
Figure 8:
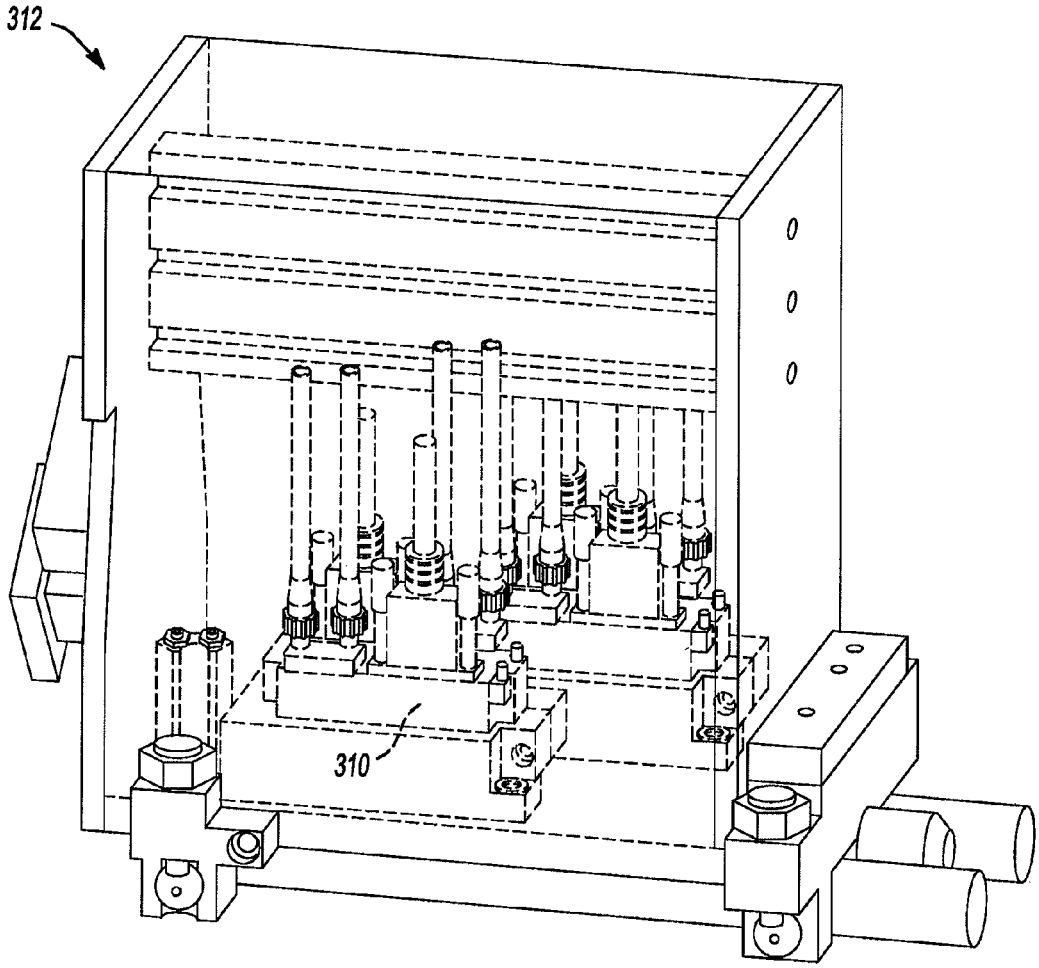
FIG. 8 is a perspective view illustrating the configuring, securing, and/or aligning system disposed in a puck according to the present teachings.
Figure 9:
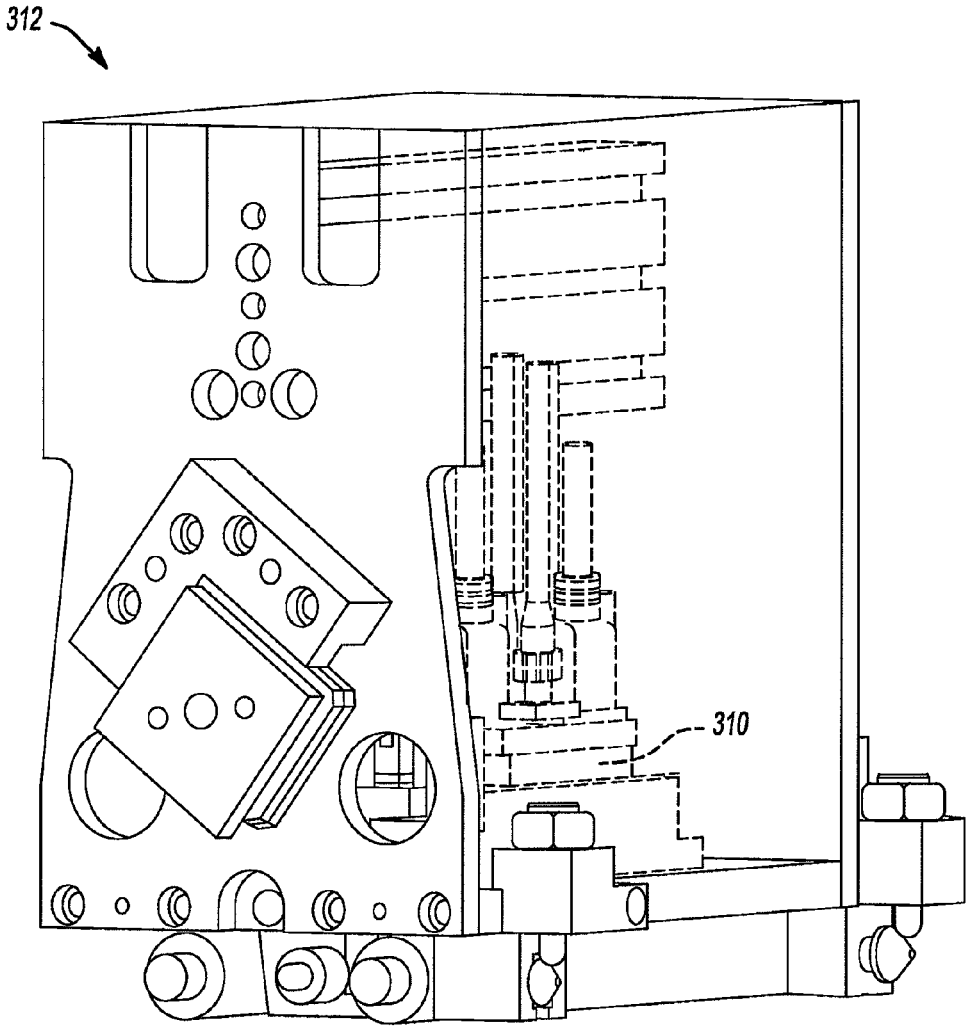
FIG. 9 is a first bottom perspective view illustrating the puck according to the present teachings.
Figure 10:
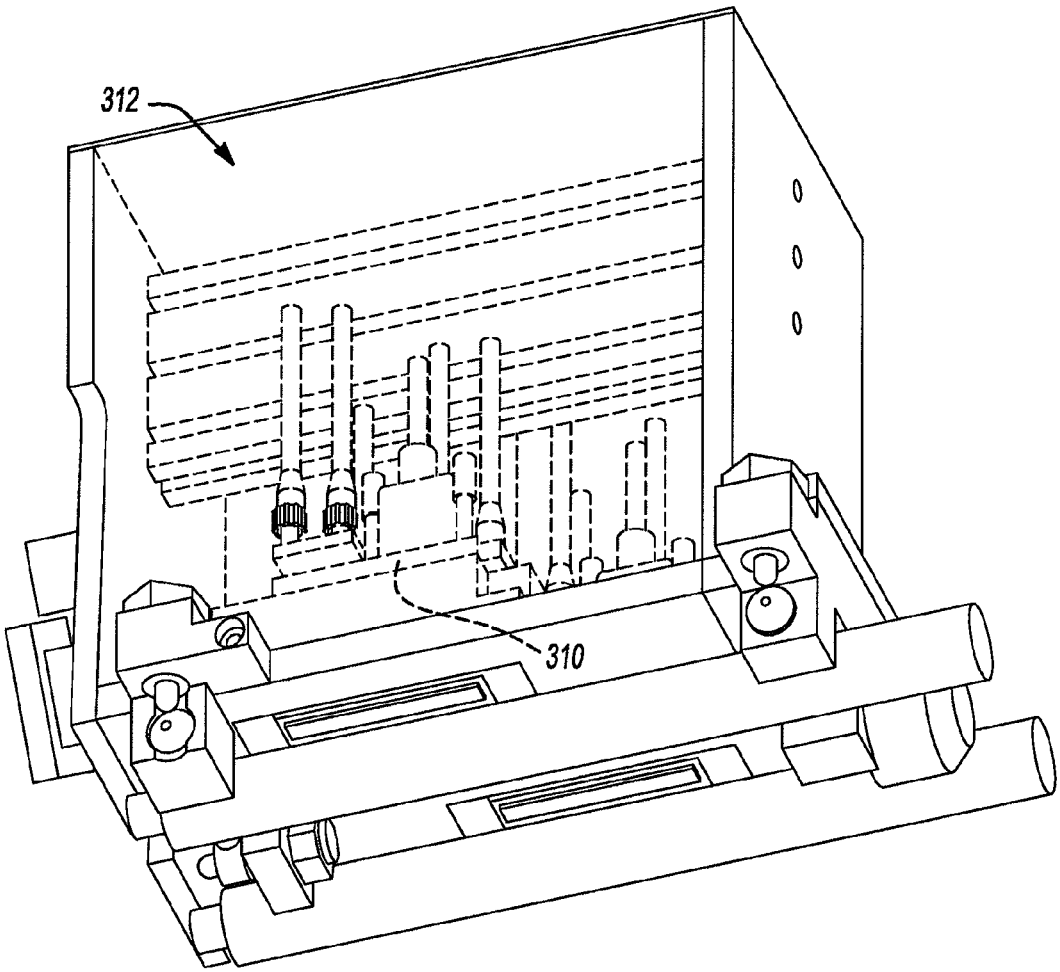
FIG. 10 is a second bottom perspective view illustrating the puck according to the present teachings.
Figure 11:
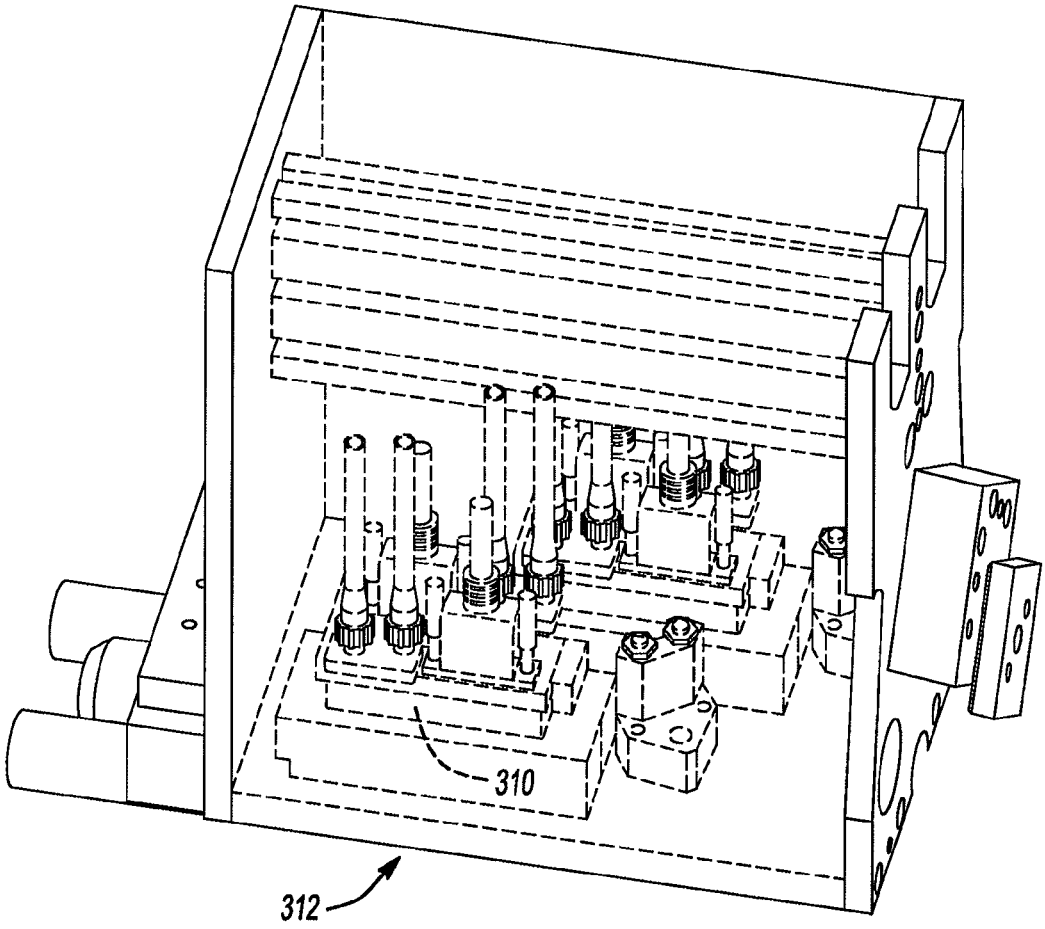
FIG. 11 is an enlarged top perspective view illustrating the puck according to the present teachings.

In some embodiments according to the present teachings and illustrated in FIGS. 1A and 1B, electric servo motors or intelligent electric actuators 110 are used to control the movement of a print head or cluster of print heads 112 within an ink jet printing system 114. During the operation of the ink jet printing system 114, there may be instances when one may need to have the print heads 112 move from a printing position to a second position. This may be due to the requirement of cleaning heads, aligning heads, feeding the substrate, or setting the print head/substrate gap.

Most Drop-On-Demand (DOD) print heads have a meniscus at the end of a nozzle that is precisely controlled in place with pressure. If it is not precisely controlled then it can malfunction or, in the worst case, the meniscus can be lost, air ingested and the nozzle will not be able to print. Some print heads are more sensitive than others to this meniscus control and to the loss of meniscus control. The Grayscale print head technology, now used for high quality ink jet printing in labels and packaging applications are very susceptible to losing nozzle meniscus when the head is jogged or moved roughly. Indeed what can be seen to be happening is that rapid acceleration can cause rapid vibrations in the meniscus causing it to be broken.

Print head manufacturers have identified this as a problem and are now developing Grayscale print heads and indeed binary print heads with technology to ensure that if a jet is lost it can quickly and automatically recover. This technology will be commercial at some point in the future, however it is believed to be a better option to avoid motion that contributes to loss of jets and provide a system that can be used with any one of a number of print heads available today. To avoid this people have used air driven pistons to move the heads smoothly, but it has been found that these systems are not sufficient to control movement in such a way as not to loose jets. (Issues related to sticky pistons, changes in air pressure and lack of control of acceleration.)

According to the principles of the present teachings, precisely controlled electrical servo motors or intelligent electrical actuators 110 are used to ensure that the movement of the print heads 112 is within a given acceleration and deceleration factor or range. It was found that certain algorithms of acceleration and deceleration were required to create maximum stability of the meniscus and hence lead to the elimination of jet loss due to head movement. The smoothness of the motion was again critical, certain stepper motors were found to be too jerky in their motion to be suitable for this application.

The servo motors 110 have an advantage of being fully programmable such that acceleration and deceleration algorithms or ranges can be precisely controlled. The servo controllers 122 (FIG. 1B) know precisely the position of the head and this can be used as an important function where print head and substrate gap can be carefully controlled. The present teachings further permit the option to program in the heights for new substrates and allow very easy optimization of print height, without the issues related to print height set up, which usually end up with rough movement and lost nozzles.

With particular reference to FIGS. 1A and 1B, ink jet printing system 114 comprises one or more print heads 112 being DOD type print heads having one or more ink nozzles. The nozzles each define an ink meniscus that is well known in the prior art. Print heads 112 are spaced relative to a platen 410 (FIG. 12) operable to carry a substrate or web thereon to be printed upon.

Print heads 112 can be mounted to a print head mechanism 117, which in turn is mounted to a support structure 116. In some embodiments, print head mechanism 117 comprises a back plate 130 having a pair of downwardly extending linear slide rods 132. Each of the linear slide rods 132 is operably received within linear bearing members 134 to achieve a smooth and highly accurate linear movement. This smooth movement, which to now has not been achieved in the art, provides a reliable and non-jostling environment that maximizes the ability to maintain an ink meniscus at the end of each print head nozzle. Print head mechanism 117 further includes, in some embodiments, a pair of servo motors 110 having motor rods 136 operably coupled to linear bearings 134 to provide movement of back plate 130 and print heads 112, such that judder is not initiated in an otherwise smooth motion due to uneven lifting across head mechanism.

It has been found that limiting acceleration and deceleration of print heads 112 can also dramatically effect the ability to maintain the meniscus at each nozzle. Therefore, it has been found that limiting acceleration and deceleration to a maximum of about 0.5 $m/s^2$ improves meniscus maintenance and, thus, improves nozzle functionality.

In some embodiments, the motion of an ink jet print head platen is precisely controlled to permit many of the typically required activities, such as head cleaning, alignment, purging, maintenance, control of head gap, and threading new substrate, without adversely bumping and/or jolting the print head, thereby minimizing damage and alignment of the print head. To this end, the print head platen, which in some embodiments can include a flat plate, a curved plate, a set of rollers, a set of bars, or the like, is designed such that it can move downwardly and away from the print heads. After the required process is completed, the platen can then move accurately back to the required position beneath the print heads.

The overall travel of the platen can be sufficient to provide enough space for various processes to be completed. The motion accuracy for the platen is such that it can return exactly to its home position (within 0.1 mm) and that it does not cause its own vibrations when moving, such that the print head meniscus is not affected due to vibrations traveling through the machine. In some embodiments, the platen can cooperate with mechanisms, such as slides and bearings, to guide the platen vertically without angling to one side.

The motion of the platen should be smooth and the travel accurately controlled. To do this, accurate programmable actuators or servo motors are used, suitable to the load bearing requirements, to provide smooth motion and controlled acceleration.

A distinct advantage of the present teachings is that the motion of the platen can be accurately set to give very controllable head heights (within 0.1 mm), which provides improved control of print quality. Furthermore, the platen location can be pre-set for different substrate types to ensure that the head-to-substrate gap is accurately maintained.

In some embodiments it might be desirable to keep the substrate held down over the platen during the process of moving the platen downwards. This can be done with tension controls and having a roller disposed on each end directing the substrate over the platen, which is moved along with the platen on the same mechanism. It can also be carried out by moving rollers down with the same mechanism as the platen is moved.

In some embodiments, the present teachings utilize three independent adjusting and clamping subsystems to secure the heads in their exact locations. Specifically, these subsystems include head-to-head alignment, insert-to-insert alignment, and color-to-color alignment.

The head-to-head alignment is done to interleave two print heads 310 to achieve 300 dpi. As illustrated in FIGS. 3-11, the present teachings use a two piece clamp design 312 that is capable of holding the two heads 310 back to back once the alignment is set. The clamp design also has several very fine adjustment screws 314 with which to move the heads side to side relative to each other. The adjustment screws are threaded in or out until perfect alignment is achieved. An optical table is used to determine the individual port locations of each head, and monitor the adjustment movements. Once the ports of the two heads are optically lined up, the two piece clamps are tightened. At this point, the heads are now secure and, in essence, behave as a single 300 dpi head.

The insert-to-insert alignment is done to stitch together multiple print heads, increasing the effective printed width. In some embodiments, fine adjustment screws, mounted on the printing plate, are used to align along two axes to accurately adjust the inserts (aligned print heads in a clamp device) location on the main printing plate. The insert adjustment screws force the inserts against miniature spring plungers that are incorporated into the clamp design, along the same two axes. Once the head stitch separation is achieved by print testing, the insert is securely fixed to the printing plate using two hold down screws.

The color-to-color alignment is done to ensure that the heads in a multiple color system print directly on top of the previous color so that four color process images can be printed. The present teachings use an adjustable "puck" system that accurately places the heads (previously interleaved in an insert, and aligned for stitch) in the exact print location required. The puck is designed to hold multiple sets of heads in the predetermined print array pattern. The puck has adjustability along three axes (x, y, z) such that the group of heads can be adjusted across the printed web, along the printed web, and the appropriate gap between the heads and the substrate being printed. This is accomplished by using fine adjustment screws, spring plungers, and gravity working as opposite forces along the x, y, and z axes.

The adjustment screws are adjusted to position the puck in its required position and provide repeatable positioning in the event that the puck is raised for maintenance. The adjustment screws contact specific surfaces on the printer that are designed to have physical robustness. With this system, each puck can be independently positioned such that the group of heads that it contains is properly positioned, giving the best print quality.

Pairs of Print Heads Mounted & Pre-Adjusted in Holder to Improve Alignment

To increase the printing resolution of a print head system above the native resolution of the individual print heads, pairs of print heads can be paired together to double the native resolution. To achieve this, the heads need to be precisely aligned in 2-directions (X and Y) plus skew. The process direction (X) can be adjusted via head firing timing that is achieved by the system electronics. Y (cross process) and skew must be adjusted mechanically as they can not be electronically adjusted and the requirements for alignment are very precise. Aligning individual print heads in a machine is a very time consuming process as the alignment requires parallel movement heads as they need to be moved together to maintain correct function. One way to achieve the required tolerances is to align pairs of print heads in holders precisely outside of the machines and then install the pre-aligned pairs into the machine and subsequently align the pairs to other pairs within a color and finally between colors. The ability to adjust the pairs of heads outside the machine makes the assembly process quicker and more efficient.

Use of Shims/Pins for Skew Adjustment

To precisely align pairs of heads for differential skew, shims can be used to adjust the parallelism of the two heads. Since the differential skew must be adjusted very precisely the use of adjustment screws is limited. To remedy this, the use of shims is possible; however the availability of shims in precise increments is difficult, typically shims are only available in increments of 0.001 of an inch. Use of gauge pins is an efficient alternative as it is possible to get precision ground pins in increments of 0.0001 of an inch. This would provide a method for precisely aligning heads by using different diameter pins between the two heads to effectively adjust skew.

In order to maintain proper print quality, it is desirable to position a web or substrate to be printed in a position that is repeatable and consistent, both in location and flatness. However, in some case, this desire is difficult to achieve. When printing on paper based webs, the paper often absorbs moisture through its edges, thereby causing the edges to differentially expand relative to the inside of the web. This results in the edges curling to a greater level than that which is tolerable by conventional printing systems. To overcome this curling tendency, the present teachings cause the web or substrate to be bent in a direction opposite the axis of the curl.

Figure 12:
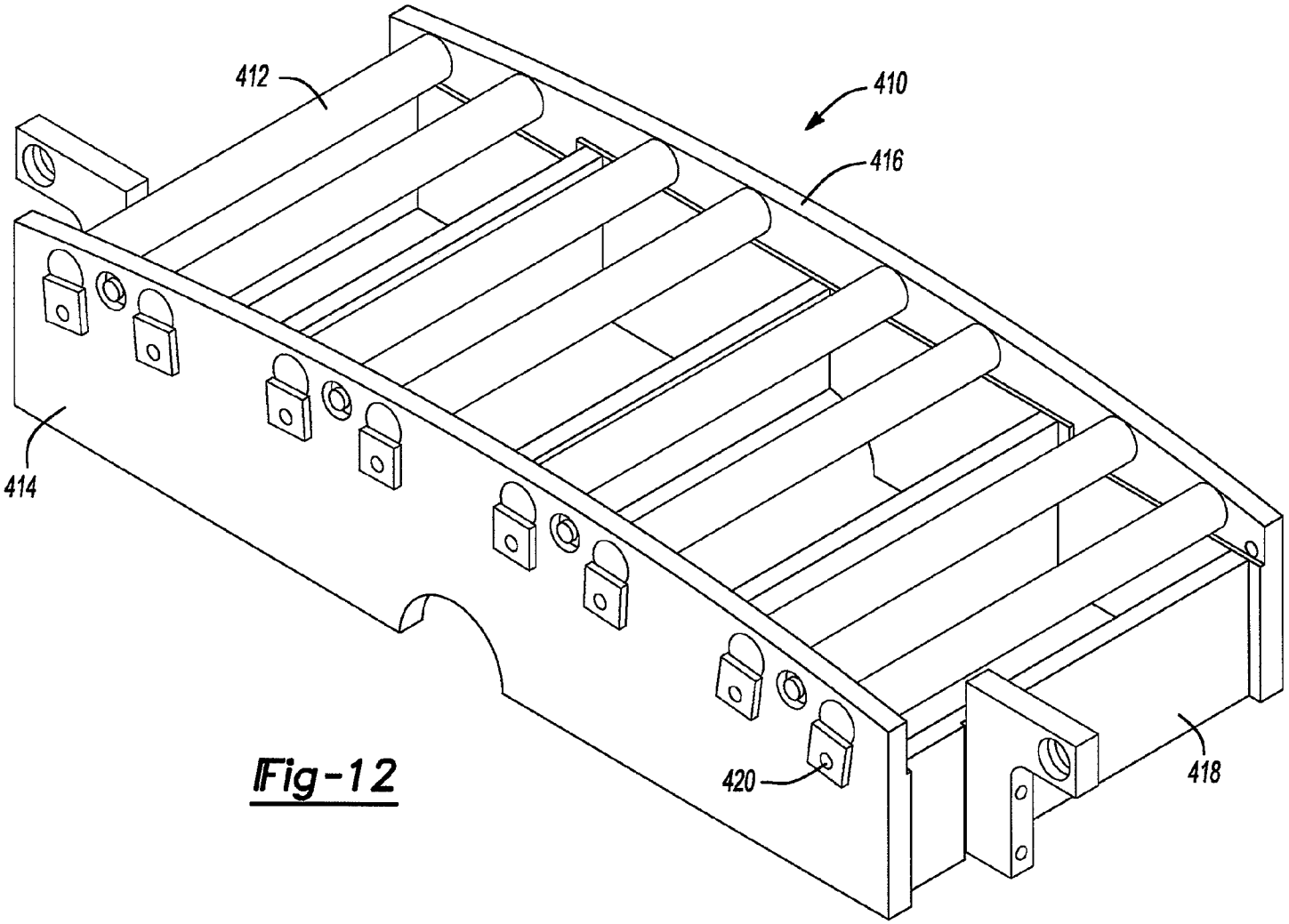
FIG. 12 is a perspective view illustrating the curved platen according to the present teachings.

The present teachings are superior to previous designs in that they provide a platen having a curved shape that is engineered to be easier and more cost effective to manufacture. As seen in FIG. 12, the curved platen 410 comprises a series of solid or hollow round rods 412, arranged in a curved pattern to support the web along a "virtual" curve. The substrate is supported by the rods spaced at specific intervals in correspondence to the location of the print heads. The open space between the rods, while unsupported, is short by comparison, so that little to no edge curl occurs. In actuality, the "virtual" curved platen is a series of short straight web sections, with the web bending slightly at the contact point of each bar.

The rods are held in place by means of a front plate 414 and a rear plate 416. Holes are placed in these plates 414, 416 to fit the rods with close tolerances and are arranged in the curved pattern. Commercially available fasteners can be used to fasten the rods 412 to plates 414, 416. The front and back plates are further structured by cross member bars 418 which are welded or bolted into place and made to be very robust to provide proper structural integrity.

As described herein, the curved platen 410 of the present teachings comprises a series of round bars arranged in a curved pattern to create a curved printer platen to support the substrate in a printing system. This design routes the substrate along a "virtual" curved surface to prevent the substrate edges from curling. It is mounted on the printer in the print zone, directly under the print head arrangement. It supports the substrate during its pass through the print zone by means of a series of round bars arranged along a curve.

It is a manufactured device comprising back plate 416 and front plate 414, joined together with bolted or welded cross members 418 into a structurally robust unit. The bars 412 are inserted into close tolerance holes machined into the plates, and held in place with commercially available fasteners 420. The bars themselves are made of oversized round stock and very structurally stable and robust. The design is scalable and, thus, is able to be easily increased in width and length of curve to accommodate larger applications.

The present teachings provide a number of advantages over the prior art, including scalable, rugged, support platens that properly support substrates that have a tendency to curl up at the edges. This results in the ability to print top quality images all the way to the edge of the web, taking full advantage of image size relative to substrate width.

As should be appreciated from the discussion herein, the use of fixed bars positioned on an arc of the present teachings solves many, if not all, of the disadvantages of the prior art. This solves several problems; since the bars are fixed there is no issue with run out. The bars are easy to manufacture as they can be precisely ground using standard manufacturing techniques, mounting the bars on a consistent arc is also straight forward by drilling holes in the mounting plates. The use of bars is an excellent solution as the bar provides sharp curvature locally under the print heads providing the best edge control of the web.

To allow for better recovery and sustainability of a print system, the ink can be thermally conditioned to match the operating parameters of the print heads. Thermal conditioning is best achieved through any of the methods of heat exchange such as conduction, convection, or radiation. Current development work has found that the methods according to the present teachings provide advantages over the prior art in that thermal conditioning of the ink occurs prior to reaching the print head, thereby improving system uptime and recovery of the system during the downtime, as well as providing consistent print quality.

Figure 13:
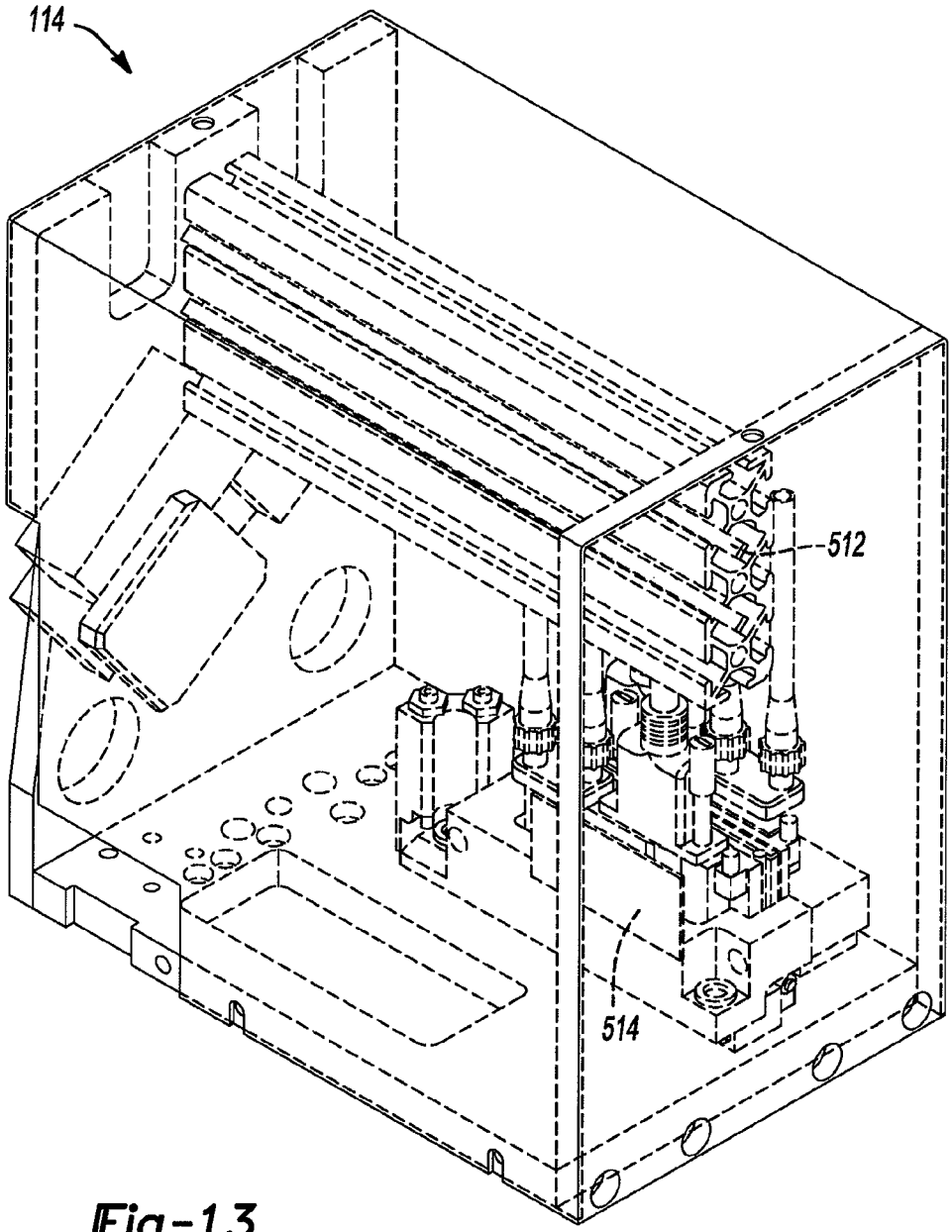
FIG. 13 is a perspective view illustrating the ink thermal conditioning system according to the present teachings, including some section designations.

As seen in FIG. 13, in some embodiments, the ink used in the print system 114 can be thermally heated by conduction through means of heat exchange from another media or a surrounding material. The use of running tubing 512, 514, 516 filled with a fluid media next to or surrounded by the ink supply tubing has provided a means to thermally condition the ink prior to entering the print head. Another method used is to place a manifold heat exchanger with the fluid media in one channel and the ink in a separate channel which also allows for thermal conditioning to occur. The use of insulating material around these methods also helps to aid in exact thermal control of the ink. Chambers for flowing a fluid media placed in the pucks (object where the print heads and/or print head holders are placed during printing) or any attached place where ink manifolds, header tanks, valves, etc. also allow for a conduction exchange to enhance the thermal conditioning of the ink prior to entry into the print heads. The use of electrically heated or cooled pads attached to or Surrounding the ink lines, pucks, ink manifolds, header tanks, valves, etc. aid in temperature control of the ink prior to entering the print head by conduction. Conduction by means of attaching to or surrounding a degas unit with a thermally controlled object as mentioned above may also increase the effectiveness and enhance the performance of the ink. This is due to the fact that if degassing is carried out, it needs to be at a temperature at least as high as that of the print heads, otherwise there is the possibility of some gas exiting the fluid in the print heads and causing sustainability issues.

A method of convection for thermally controlling the ink prior to it entering the print head is to enclose the lines, pumping equipment, tanks, valves, puck, etc. within a conditioned environment. This environment can be created through the use of either a fluid media being pumped, placed or forced into the enclosure or surrounding the enclosure that is maintained at the desired temperature. Another method of creating the convection environment is to place an electric heater pad or a fluid media chamber within this enclosed area, which can also include the chambers, manifolds, and tubing mentioned above allowing for a dual purposing of these items. By the use of the enclosure, the entire assembly or combination of equipment can be maintained at a specified temperature which helps to prevent temperature variations from occurring in the ink along the flow path.

The use of radiant heat from an electric heater, a lamp heater, fluid media transport system or any other heating device will also help to thermally condition the ink prior to it entering the print head. This radiant method is best used in heating the surfaces of the lines or any other device or object used in ink transport or storage which maintains a certain level of heat conduction into the ink. Ink can also be directly heated by radiation if the surface material will either pass the radiation or the source is directly exposed to the ink.

All of these methods, at least in part, help to maintain ink thermal control to enhance performance and sustainability of the print system.

The invention claimed is:

1. An ink jet printer for printing ink on a substrate, the ink jet printer comprising:

a first print head comprising at least one nozzle for defining a meniscus of the ink and for outputting the ink during a printing operation wherein the ink is delivered to the substrate from the first print head;

a platen operable to carry the substrate;

a support structure;

a print head mechanism coupled to the support structure and carrying the first print head, the print head mechanism for moving the first print head relative to the platen; and a controller for controllably limiting any of the acceleration or deceleration of the print head mechanism any of towards the platen or away from the platen, to maintain the defined ink meniscus when the platen is moved for an operation other than the printing operation, wherein the operation other than the printing operation comprises any of print head cleaning, print head alignment, purging, maintenance, control of head gap, or threading of a new substrate.

2. The ink jet printer of claim 1, wherein the print head mechanism comprises a servo motor operably coupled between the support structure and the first print head, wherein the servo motor drives the first print head in response to the controller.

3. The ink jet printer of claim 1, wherein the print head mechanism comprises a linear bearing operably coupled to the support structure for minimizing jarring movement of the first print head to maintain the ink meniscus.

4. The ink jet printer of claim 1, wherein the controller is operable to limit acceleration of the print head any of towards the platen or away from the platen to be less than 0.5 $m/s^2$ to maintain the defined ink meniscus.

5. The ink jet printer of claim 1, wherein the controller is operable to limit deceleration of the print head any of towards the platen or away from the platen to be less than −0.5 $m/s^2$ to maintain the defined ink meniscus.

6. The ink jet printer of claim 1, further comprising:

a heating system disposed at least partially upstream from the first print head, the heating system for heating the ink before the ink enters the first print head.

7. The ink jet printer of claim 6, wherein the heating system comprises a housing cover for reflecting heat back toward the first print head.

8. The ink jet printer of claim 6, wherein the heating system comprises an inlet line for transmitting a heated fluid therethrough to heat the ink.

9. The ink jet printer of claim 6, wherein the heating system comprises a fluid chamber disposed adjacent the first print head for heating the ink.

10. The ink jet printer of claim 6, wherein the heating system heats by any of convection, conduction, or radiation.

11. The ink jet printer of claim 1, further comprising:

a second print head for outputting ink; and a mounting structure coupled to the print head mechanism and supporting the first print head and the second print head, the mounting structure having a first adjustment system for adjusting the first print head relative to the second print head in a first direction and a second adjustment system for adjusting the first print head relative to the second print head in a second direction, the first direction being different than the second direction.

12. The ink jet printer of claim 11, wherein the mounting structure further comprises a third adjustment system for adjusting the first print head relative to the second print head in a third direction, the third direction being different than the first direction and the second direction.

13. The ink jet printer of claim 1, wherein the platen comprises:

a first plate;

a second plate; and a plurality of support rods extending between the first plate and the second plate, the plurality of support rods being positioned to define a generally arcuate path to support the substrate.

14. The ink jet printer of claim 13, further comprising:

a plurality of cross members fixedly coupled between the first plate and the second plate, the plurality of cross members supporting the first plate and the second plate in a predetermined position.

15. The ink jet printer of claim 13, wherein each of the plurality of support rods is fixedly coupled against rotation to at least one of the first plate and the second plate.

16. A method, comprising the steps of:

providing an ink jet printer comprising a first print head comprising at least one nozzle for outputting ink during a printing operation wherein the ink is delivered to the substrate from the first print head, a platen operable to carry a substrate, a support structure, a print head mechanism coupled to the support structure and carrying the first print head, the print head mechanism for moving the first print head relative to the platen, and a controller;

defining a meniscus of ink within the nozzle of the first print head; and operating the controller to controllably limit any of acceleration or deceleration of the print head mechanism any of towards the platen or away from the platen, to maintain the defined ink meniscus when the platen is moved for an operation other than the printing operation, wherein the operation other than the printing operation comprises any of print head cleaning, print head alignment, purging, maintenance, control of head gap, or threading of a new substrate.

17. The method of claim 16, wherein the print head mechanism comprises a servo motor operably coupled between the support structure and the first print head, and wherein the method further comprises the step of:

driving the first print head with the servo motor in response to the controller.

18. The method of claim 16, wherein the print head mechanism comprises a linear bearing operably coupled to the support structure for minimizing jarring movement of the first print head to maintain the ink meniscus.

19. The method of claim 16, further comprising the step of:

controllably limiting acceleration of the print head any of towards the platen or away from the platen to be less than 0.5 $m/s^2$ to maintain the defined ink meniscus.

20. The method of claim 16, further comprising the step of:

controllably limiting deceleration of the print head any of towards the platen or away from the platen to be less than −0.5 $m/s^2$ to maintain the defined ink meniscus.

21. The method of claim 16, wherein the ink jet printer further comprises a heating system disposed at least partially upstream from the first print head, and wherein the method further comprises the step of:

heating the ink with the heating system before the ink enters the first print head.

22. The method of claim 21, wherein the heating system comprises a housing cover for reflecting heat back toward the first print head.

23. The method of claim 21, wherein the heating system comprises an inlet line for transmitting a heated fluid therethrough to heat the ink.

24. The method of claim 21, wherein the heating system comprises a fluid chamber disposed adjacent the first print head for heating the ink.

25. The method of claim 21, wherein the heating system heats by any of convection, conduction, or radiation.

26. The method of claim 16, wherein the ink jet printer further comprises:

a second print head for outputting ink; and a mounting structure coupled to the print head mechanism and supporting the first print head and the second print head, the mounting structure having a first adjustment system for adjusting the first print head relative to the second print head in a first direction and a second adjustment system for adjusting the first print head relative to the second print head in a second direction, the first direction being different than the second direction.

27. The method of claim 26, wherein the mounting structure further comprises a third adjustment system for adjusting the first print head relative to the second print head in a third direction, the third direction being different than the first direction and the second direction.

28. The method of claim 16, wherein the platen comprises:

a first plate;

a second plate; and a plurality of support rods extending between the first plate and the second plate, the plurality of support rods being positioned to define a generally arcuate path to support the substrate.

29. The method of claim 28, further comprising:

a plurality of cross members fixedly coupled between the first plate and the second plate, the plurality of cross members supporting the first plate and the second plate in a predetermined position.

30. The method of claim 28, wherein each of the plurality of support rods is fixedly coupled against rotation to at least one of the first plate and the second plate.

31. A method, comprising the steps of:

providing an ink jet printer comprising a first print head comprising at least one nozzle for outputting ink, a second print head for outputting ink, a platen operable to carry a substrate, a support structure, a print head mechanism coupled to the support structure and carrying the first print head, the print head mechanism for moving the first print head relative to the platen, a mounting structure coupled to the print head mechanism and supporting the first print head and the second print head, the mounting structure having a first adjustment system for adjusting the first print head relative to the second print head in a first direction, a second adjustment system for adjusting the first print head relative to the second print head in a second direction, the first direction being different than the second direction, and a third adjustment system for adjusting the first print head relative to the second print head in a third direction, the third direction being different than the first direction and the second direction, and a controller;

defining a meniscus of ink within the nozzle of the first print head; and operating the controller to maintain the print head mechanism in a stationary position to maintain the defined ink meniscus when the platen is moved for any of head cleaning, alignment, purging, maintenance, control of head gap, or threading of a new substrate.

32. An ink jet printer for printing ink on a substrate, the ink jet printer comprising:

a first print head comprising at least one nozzle for defining a meniscus of the ink and for outputting the ink;

a second print head for outputting the ink;

a platen operable to carry the substrate;

a support structure;

a print head mechanism coupled to the support structure and carrying the first print head, the print head mechanism for moving the first print head relative to the platen;

a mounting structure coupled to the print head mechanism and supporting the first print head and the second print head, the mounting structure comprising a first adjustment system for adjusting the first print head relative to the second print head in a first direction, a second adjustment system for adjusting the first print head relative to the second print head in a second direction, the first direction being different than the second direction, and a third adjustment system for adjusting the first print head relative to the second print head in a third direction, the third direction being different than the first direction and the second direction; and a controller for controllably maintaining the print head mechanism in a stationary position to maintain the defined ink meniscus when the platen is moved for any of head cleaning, alignment, purging, maintenance, control of head gap, or threading of a new substrate.

33. An ink jet printer for printing ink on a substrate, the ink jet printer comprising:

a first print head comprising at least one nozzle for defining a meniscus of the ink and for outputting the ink during a printing operation wherein the ink is delivered to the substrate from the first print head;

a second print head for outputting ink;

a platen operable to carry the substrate;

a support structure;

a print head mechanism coupled to the support structure and carrying the first print head, the print head mechanism for moving the first print head relative to the platen;

a mounting structure coupled to the print head mechanism and supporting the first print head and the second print head, the mounting structure having a first adjustment system for adjusting the first print head relative to the second print head in a first direction, a second adjustment system for adjusting the first print head relative to the second print head in a second direction, the first direction being different than the second direction, and a third adjustment system for adjusting the first print head relative to the second print head in a third direction, the third direction being different than the first direction and the second direction; and a controller for controllably maintaining the print head mechanism in a stationary position to maintain the defined ink meniscus when the platen is moved for an operation other than the printing operation, wherein the operation other than the printing operation comprises any of print head cleaning, print head alignment, purging, maintenance, control of head gap, or threading of a new substrate.

34. A method, comprising the steps of:

providing an ink jet printer comprising a first print head comprising at least one nozzle for outputting ink during a printing operation wherein the ink is delivered to the substrate from the first print head, a second print head for outputting ink, a platen operable to carry a substrate, a support structure, a print head mechanism coupled to the support structure and carrying the first print head, the print head mechanism for moving the first print head relative to the platen, a mounting structure coupled to the print head mechanism and supporting the first print head and the second print head, the mounting structure having a first adjustment system for adjusting the first print head relative to the second print head in a first direction, a second adjustment system for adjusting the first print head relative to the second print head in a second direction, the first direction being different than the second direction, and a third adjustment system for adjusting the first print head relative to the second print head in a third direction, the third direction being different than the first direction and the second direction, and a controller;

defining a meniscus of ink within the nozzle of the first print head; and operating the controller to maintain the print head mechanism in a stationary position to maintain the defined ink meniscus when the platen is moved for an operation other than the printing operation, wherein the operation other than the printing operation comprises any of print head cleaning, print head alignment, purging, maintenance, control of head gap, or threading of a new substrate.

* * * * *